United States Patent [19]

Kawahara et al.

[11] Patent Number: 4,956,333

[45] Date of Patent: Sep. 11, 1990

[54] HEAT-SENSITIVE RECORDING MATERIAL

[75] Inventors: Kenichi Kawahara, Iwatsuki; Masaharu Nomura, Hasuda; Hiroaki Tsugawa, Matsudo; Hirofumi Iwamoto, Omiya, all of Japan

[73] Assignee: Nippon Kayaku Kabushiki Kaisha, Tokyo, Japan

[21] Appl. No.: 409,043

[22] Filed: Sep. 18, 1989

[30] Foreign Application Priority Data

Sep. 19, 1988 [JP] Japan ..... 63-232642

[51] Int. Cl.[5] ..... B41M 5/18

[52] U.S. Cl. ..... 503/209; 503/208; 503/225

[58] Field of Search ..... 427/150–152; 503/208, 209, 225

[56] References Cited

U.S. PATENT DOCUMENTS 4,573,062 2/1986 Satake et al. ..... 503/209

4,628,336 12/1986 Satake et al. ..... 503/209

FOREIGN PATENT DOCUMENTS 59-73990 4/1984 Japan ..... 503/

*Primary Examiner*—Bruce H. Hess

*Attorney, Agent, or Firm*—Henry C. Nields

[57] ABSTRACT

A heat-sensitive recording material characterized in that a heat-sensitive color-developing layer containing a compound represented by the formula (I),

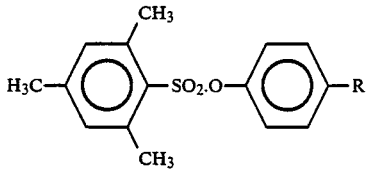

(I)

wherein R represents a hydrogen atom or a methyl group, a leuco dye and an acidic substance is formed on a support.

1 Claim, No Drawings

HEAT-SENSITIVE RECORDING MATERIAL

BACKGROUND OF THE INVENTION

1. Field of the Invention

The present invention relates to a heat-sensitive recording material, and particularly, to a heat-sensitive recording material having high heat sensitivity and being superior in high-speed recording.

2. Description of the Prior Art

Heat-sensitive recording materials which make use of the heat color-development reaction of a colorless to pale leuco dye with an organic acid are disclosed in JP-B-43-4160, JP-B-45-14039, etc. and put to wide and practical use.

In these recording fields, recently, demands for an increase in the rate and density of recording have become so strong that the development of color-development recording apparatus which can meet these demands and recording materials suitable therefor is also being strongly demanded. In these apparatus, reducing the heat amount supplied to the thermal head is planned for energy saving and an improvement in the durability of the thermal head. Because of this, for the heat-sensitive recording materials used is also being required a sufficient sensitivity enough to give clear color-developed records (images) with smaller amount of heat.

Practically, however, when the heat-sensitive recording paper is used in thermal printers, insufficient color-developing sensitivity and slowed-down printing speed are observed in many cases. In order to improve these drawbacks, additives are in use. For example, examples of use of various additives are disclosed in JP-B-50-14531, JP-A-60-82382, JP-A-59-73990, JP-A-60-56588, JP-A-58-98285, JP-A-60-176794, JP-A-59-184692, JP-A-58-87094, JP-A-56-72996, JP-A-60-178086, etc. By the use of these compounds, there is observed a tendency for the developed color depth to become strong for the heat amount supplied. However, there are observed the following drawbacks: The fastnesses to heat, moisture, water, plasticizer, etc. of the color-developed parts are inferior; these compounds crystallize out as white crystals on the recorded (color-developed) images during storage after heat- sensitive color-development (the so-called blooming); and color-development easily takes place in a low-temperature region to form fog on the ground part, which lowers the contrast between the color-developed image and the ground part on the heat-sensitive paper. As described above, when additives are added in order to improve the color-developing sensitivity, the foregoing problems arise in many cases in contrary to the object. For this reason, a satisfactory method has not yet been established although various additives have been proposed.

SUMMARY OF THE INVENTION

An object of the present invention is to develop a high-sensitivity heat-sensitive recording material which gives color-developed images having excellent fastnesses, keeps the ground part in good conditions, shows little blooming phenomenon and is suitable for high-speed recording.

The present inventors have extensively studied to develop a heat-sensitive recording material having the foregoing characteristics, and as a result, have completed the present invention.

The present invention provides a heat-sensitive recording material characterized in that a heat-sensitive color-developing layer containing a compound represented by the formula (I),

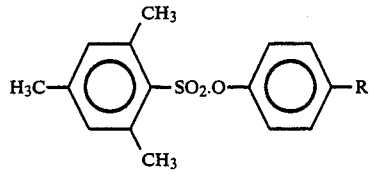

(I)

wherein R represents a hydrogen atom or a methyl group, a leuco dye and an acidic substance is formed on a support.

The heat-sensitive recording material of the present invention is easy to produce, and also it is superior in the high-speed recording characteristics because of its high sensitivity. When the heat-sensitive recording material of the present invention is subjected to heat-sensitive color-development by the usual method, the blooming is little observed, the ground part is free from fog, being kept white, the undeveloped part has little fog when stored under a wet-heating condition, and the color-developed image produced has excellent fastnesses to water, moisture, plasticizer and heat.

DESCRIPTION OF THE PREFERRED EMBODIMENTS

The heat-sensitive recording material of the present invention is produced as follows: A leuco dye and a developer described later are each finely pulverized and then mixed; to the resulting mixture are added the compound of the foregoing formula (I) and if necessary, other components to prepare a coating solution for forming a heat-sensitive color-developing layer; and the coating solution is coated onto a support (e.g. paper, synthetic paper, plastic film) so that its dry weight is usually 2 to 30 g/m$^2$, more preferably 5 to 15 g/m$^2$, and then dried. In the heat-sensitive recording material of the present invention, the amount of the compound represented by the formula (I) is usually 1 to 6 times by weight, preferably 2 to 5 times by weight based on the leuco dye. The weight ratio of the compound (I) to the heat-sensitive color-developing layer corresponds to 3 to 25%.

Specific examples of the compound represented by the formula (I) include the following:

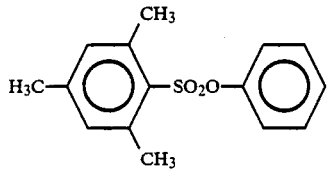

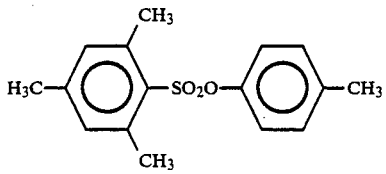

These compounds are obtained by introducing a sulfonyl chloride group into mesitylene by the usual method, and then reacting the resulting compound with phenol or p-cresol in the presence of an alkali.

Examples of the colorless or pale leuco dye used in the present invention include xanthene compounds, triarylmethane compounds, spiropyran compounds, diphenylmethane compounds, thiazine compounds, fluorene compounds, etc. Specific examples of these compounds will be shown below. The xanthene compounds include 2-anilino-3-methyl-6-diethylaminofluoran, 2-anilino-3-methyl-6-cyclohexylmethylaminofluoran, 2-anilino-3-methyl-6-isopentylethylaminofluoran, 2-anilino-3-methyl-6-dibutylaminofluoran, 2-p-chloroanilino-3-methyl-6-diethylaminofluoran, 2-p-fluoroanilino-3-methyl-6-diethylaminofluoran, 2-p-fluoroanilino- 3-methyl-6-dibutylaminofluoran, 2-anilino-3-methyl-6-(p-toluidinoethyl)aminofluoran, 2-p-toluidino-3-methyl-6-diethylaminofluoran, 2-o-chloroanilino-6-diethylaminofluoran, 2-o-chloroanilino-6-dibutylaminofluoran, 2-o-fluoroanilino-6-diethylaminofluoran, 2-o-fluoroanilino-6-dibutylaminofluoran, 2-anilino-3-methyl-6-piperidinofluoran, 2-anilino-3-methyl-6-pyrrolidinofluoran, 2-m-trifluoromethylanilino-6-diethylaminofluoran, 2-ethoxyethylamino-3-chloro-6-diethylaminofluoran, 2-anilino-3-chloro-6-diethylamino-fluoran, 2-anilino-3-methyl-6-diphenylaminofluoran, 2-phenyl-6-diethylaminofluoran, 2-chloro-3-methyl-6-diethylaminofluoran, 2-chloro-6-diethylaminofluoran, 2-methyl-6-diethylaminofluoran, etc. The triarylmethane compounds include 3,3-bis(p-dimethylaminophenyl)-6-dimethylaminophthalide (another name, Crystal Violet lactone), 3,3-bis(p-dimethylaminophenyl)phthalide, 3-(p-dimethylaminophenyl)-3-(1,2-dimethylaminoindol-3-yl)phthalide, etc. The spiropyran compounds include 3-methyl-spiro-dinaphthopyran, 1,3,3-trimethyl-6'-nitro-8'-methoxyspiro(indoline-2,2'-benzopyran), etc. The diphenylmethane compounds include 4,4'-bis-dimethylaminobenzhydrin benzyl ether, N-halophenylleucoauramine, etc. The thiazine compounds include benzoylleucomethylene blue, p-nitrobenzylleucomethylene blue, etc.

In addition to the compounds described above, the following compounds may also be used: Divinyl group-containing phthalide derivatives such as bis-3,3-[bis-1,1-(p-dimethylaminophenyl)ethyleno-2]phthalide, bis-3,3-[bis-1,1-(p-dimethylaminophenyl)ethyleno-2]-4,5,6,7-tetrachlorophthalide, bis-3,3-[bis-1,1-(p-diethylaminophenyl)ethyleno-2]-4,5,6,7-tetrachlorophthalide, bis-3,3-[bis-1,1-(p-dimethylaminophenyl)ethyleno-2]-4 (or 7)-nitrophthalide, etc. and fluorene compounds such as 3,6-bis(dimethylamino)fluorenespiro(9,3')-6'-dimethylaminophthalide, 3,6-bis(diethylamino)fluorenespiro(9,3')-6'-diethylaminophthalide, etc.

These leuco compounds are used alone or in combination. Their amount may optionally be selected, but it is usually 0.3 to 5% by weight, preferably 1 to 3% by weight based on the support.

An acidic substance refers to a substance which is solid at room temperature, melts upon heating and can become a developer by reaction with a colorless or pale color-developable compound. For example, there are mentioned phenolic compounds such as p-octylphenol, p-tert-butylphenol, p-phenylphenol, 1,1-bis(p-hydroxyphenyl)propane, 2,2-bis(p-hydroxyphenyl)propane (Bisphenol A), 1,1-bis(p-hydroxyphenyl)cyclohexane, 4,4'-thiobisphenol, 4,4'-sulfonyldiphenol, 4,4'-sulfonylbis(2-allylphenol), etc.; aromatic carboxylic acid derivatives and aromatic carboxylic acids such as benzyl p-hydroxybenzoate, ethyl p-hydroxybenzoate, dibenzyl 4-hydroxyphthalate, dimethyl 4-hydroxyphthalate, ethyl 5-hydroxyisophthalate, 3,5-di-tertbutylsalicylic acid, 3,5-di-α-methylbenzylsalicylic acid, etc.; and their polyvalent metal salts.

Binders, may properly be used to prepare the heat-sensitive recording material of the present invention.

The binders include for example methyl cellulose, hydroxyethyl cellulose, carboxymethyl cellulose, polyvinyl alcohol, carboxy group-modified polyvinyl alcohol, polyvinyl pyrrolidone, polyacrylamide, polyacrylic acid, starch and its derivatives, casein, gelatin, alkali metal salts of a styrene/maleic acid anhydride copolymer, water-soluble alkali metal salts of an iso- or diiso-butylene/maleic acid anhydride copolymer and aqueous emulsions of polyvinyl acetate, vinyl chloride/vinyl acetate copolymer, polystyrene, polyacrylic acid, polyester, polyurethane, styrene/butadiene/acrylic acid copolymer, etc.

Fillers may be used if necessary to prepare the heat-sensitive recording material of the present invention.

Examples of the fillers include for example calcium carbonate, magnesium carbonate, magnesium oxide, silica, talc, alumina, magnesium hydroxide, aluminum hydroxide, barium sulfate, aluminum stearate, styrene resin, ureaformalin resin, etc. In addition, lubricants (e.g. zinc stearate, calcium stearate), various surface active agents and defoaming agents, etc. are added as need arises.

In combination with the compound of the present invention, known heat-fusible substances may be used. The heat-fusible substances include waxes such as animal and plant waxes, polyethylene waxes, synthetic waxes, etc., higher fatty acids, higher fatty acid amides, metal salt of higher fatty acids, carboxylic acid esters such as dimethylterephthalate, diphenylterephthalate, etc., 1-benzyloxynaphthalene, 2-benzoyloxynaphthalene, 2-benzyloxynaphthalene, p-benzylbiphenyl, m-terphenyl, 1,2-di-(3-methylphenoxy)ethane, etc.

If necessary, an overcoat layer may be formed on the heat-sensitive recording material of the present invention by the usual method.

The present invention will be illustrated more specifically with reference to the following examples.

REFERENCE EXAMPLE

Synthesis of phenyl mesitylenesulfonate 9.4 g of phenol is added to a mixture containing 9.17 g of 48% NaOH, 50 ml of water and 50 ml of toluene. To the resulting mixture is added 22.9 g of mesitylenesulfonyl chloride, and reaction is carried out at 60° to 65° C. for 1 hour. After separating the aqueous layer, toluene is removed from the toluene layer by distillation. The resulting desired compound is purified with methanol.

Yield 26.9 g.

m.p. 102°–104.5° C.

Synthesis of 4-methylphenyl mesitylenesulfonate 10.8 g of p-cresol is added to a mixture containing 9.17 g of 48% NaOH, 50 ml of water and 50 ml of toluene. To the resulting mixture is added 22.9 g of mesitylenesulfonyl chloride, and reaction is carried out at 60° to 65° C. for 1 hour. After separating the aqueous layer, toluene is removed from the toluene layer by distillation. The resulting desired compound is purified with methanol.

Yield 27.3 g.
m.p. 102°-104° C.

EXAMPLE 1

Three mixtures of the following compositions were separately finely pulverized to an average particle diameter of 0.5 to 3μ on a sand grinder to prepare (A), (B) and (C) liquid.

(A) liquid:
2-(o-Fluoroanilino)-6-dibutylaminofluoran: 25 g
Gosenol GL-05H (25% aqueous PVA solution, produced by Nippon Gosei Kagaku Kogyo Co., Ltd.): 20 g
Water: 55 g
(B) liquid:
Bisphenol A: 20 g
Gosenol GL-05H (same as described above): 18 g
Water: 62 g
(C) liquid:
Phenyl mesitylenesulfonate (compound obtained in Reference example): 5.2 g
Calcium carbonate: 23.5 g
Zinc stearate: 1.3 g
Gosenol GL-05H (same as described above): 9.0 g
Water: 61.0 g (A), (B) and (C) liquids were mixed in a ratio of 6:30:58 to prepare a coating liquid for forming a heat-sensitive layer (heat-sensitive coating liquid). The resulting coating liquid was coated onto the surface of a wood-free paper having a basis weight of 50 g/m$^2$ so that the dry solid content was 9.2 g/m$^2$ and then dried to obtain the heat-sensitive recording material (heat-sensitive recording paper) of the present invention. Further, as to the heat-sensitive recording material used only for the dynamic sensitivity test, an overcoat layer was applied to the foregoing heat-sensitive layer. The composition of this overcoating liquid is a mixture of a compound consisting mainly of a colloidal hydrated aluminum silicate (Kunipiar F, produced by Kunimine Kogyo Co.) and a self-crosslinkable acrylic emulsion consisting mainly of an ammonium methacrylate/ethyl acrylate/methyl methacrylate copolymer in a weight ratio of 1:5 as a solid content. This overcoating liquid was applied so that the dry thickness was 1μ and then dried to obtain the heat-sensitive recording material of the present invention having an overcoat layer on the surface.

EXAMPLE 2

The heat-sensitive recording material of the resent invention was obtained in the same manner as in Example 1 except that p methylphenyl mesitylenesulfonate was used in place of phenyl mesitylenesulfonate.

COMPARATIVE EXAMPLES 1 to 3

The heat-sensitive recording materials for comparison were obtained in the same manner as in Example 1 except that the additives shown in Table 1 were used in place of phenyl mesitylenesulfonate.

EXAMPLES 3 to 5

The heat-sensitive recording materials of the present invention were obtained in the same manner as in Example 1 except that the leuco dyes shown in Table 1 were used in place of 2-(o-fluoroanilino)-6-dibutylaminofluoran, and that 4,4'-sulfonyl-bis(2-allylphenol) was used in place of bisphenol A.

EXAMPLES 6 to 8

The heat-sensitive recording materials of the present invention were obtained in the same manner as in Examples 3 to 5 except that p-methylphenyl mesitylenesulfonate was used in place of phenyl mesitylenesulfonate.

EXAMPLES 9

The heat-sensitive recording material of the present invention was obtained in the same manner as in Example 1 except that bisphenol A, a developer, was replaced by 4,4'-sulfonyl-bis(2-allylphenol).

EXAMPLE 10

The heat-sensitive recording material of the present invention was obtained in the same manner as in Example 9 except that p-methylphenyl mesitylenesulfonate was used in place of phenyl mesitylenesulfonate.

EXAMPLES 11 AND 12

The heat-sensitive recording materials of the present invention were obtained according to Example 10 using 2-anilino-3-methyl-6-dibutylaminofluoran as a leuco dye in place of 2-(o-fluoroanilino)-6-dibutylaminofluoran and phenyl mesitylenesulfonate and p-methylphenyl mesitylenesulfonate as an additive.

The quality performance tests were carried out using the heat-sensitive recording materials of the present invention and heat-sensitive recording sheets for comparison obtained above.

Table 1 shows the leuco dyes, developers and additives used in Examples 1 to 12 and Comparative examples 1 to 3. Table 2 shows the results of the quality performance tests on the heat-sensitive recording materials obtained in Examples 1 to 12 and Comparative examples 1 to 3.

TABLE 1

| | Leuco dye | Developer | Additive |
|---|---|---|---|
| Example 1 | 2-(o-Fluoroanilino)-6-dibutylaminofluoran | Bisphenol A | Phenyl mesitylenesulfonate |
| Example 2 | 2-(o-Fluoroanilino)-6-dibutylaminofluoran | Bisphenol A | p-Methylphenyl mesitylenesulfonate |
| Comparative Example 1 | 2-(o-Fluoroanilino)-6-dibutylaminofluoran | Bisphenol A | Phenyl-p-toluenesulfonate |
| Comparative Example 2 | 2-(o-Fluoroanilino)-6-dibutylaminofluoran | Bisphenol A | p-Benzylbiphenyl |
| Comparative Example 3 | 2-(o-Fluoroanilino)-6-dibutylaminofluoran | Bisphenol A | Stearic acid amide |
| Example 3 | 2-Anilino-3-methyl-6-(N-ethyl-N-isopentylamino)fluoran | 4,4'-Sulfonyl-bis(2-allylphenol) | Phenyl mesitylenesulfonate |
| Example 4 | 2-Anilino-3-methyl-6-diethylaminofluoran | 4,4'-Sulfonyl-bis(2-allylphenol) | Phenyl mesitylenesulfonate |
| Example 5 | 2-Anilino-3-methyl-6-(N-methyl-N-cyclohexylamino)fluoran | 4,4'-Sulfonyl-bis(2-allylphenol) | Phenyl mesitylenesulfonate |

TABLE 1-continued

| | Leuco dye | Developer | Additive |
|---|---|---|---|
| Example 6 | 2-Anilino-3-methyl-6-(N-ethyl-N-isopentylamino)fluoran | 4,4'-Sulfonyl-bis(2-allylphenol) | p-Methylphenyl mesitylenesulfonate |
| Example 7 | 2-Anilino-3-methyl-6-diethylaminofluoran | 4,4'Sulfonyl-bis(2-allylphenol) | p-Methylphenyl mesitylenesulfonate |
| Example 8 | 2-Anilino-3-methyl-6-(N-methyl-N-cyclohexylamino)fluoran | 4,4'-Sulfonyl-bis(2-allylphenol) | p-Methylphenyl mesitylenesulfonate |
| Example 9 | 2-(o-Fluoroanilino)-6-dibutylaminofluoran | 4,4'-Sulfonyl-bis(2-allylphenol) | Phenyl mesitylenesulfonate |
| Example 10 | 2-(o-Fluoroanilino)-6-dibutylaminofluoran | 4,4'-Sulfonyl-bis(2-allylphenol) | p-Methylphenyl mesitylenesulfonate |
| Example 11 | 2-Anilino-3-methyl-6-dibutylaminofluoran | 4,4'-Sulfonyl-bis(2-allylphenol) | Phenyl mesitylenesulfonate |
| Example 12 | 2-Anilino-3-methyl-6-dibutylaminofluoran | 4,4'-Sulfonyl-bis(2-allylphenol) | p-Methylphenyl mesitylenesulfonate |

TABLE 2

| | Coloration of the ground | Static sensitivity (°C.) | | | Dynamic sensitivity (ms) | | | | | | | Heat resistance | | Moisture resistance | | Water resistance | Plasticizer resistance | Blooming |
|---|---|---|---|---|---|---|---|---|---|---|---|---|---|---|---|---|---|---|
| | part | 80 | 90 | 140 | 0.8 | 1.0 | 1.2 | 1.4 | 1.6 | 1.8 | 2.0 | A | B% | A | B % | B % | B % | |
| Example 1 | 0.07 | 0.13 | 0.97 | 1.31 | 0.10 | 0.16 | 0.27 | 0.37 | 0.51 | 0.67 | 0.81 | 0.09 | 101 | 0.08 | 100 | 58 | 72 | O |
| Example 2 | 0.07 | 0.12 | 0.86 | 1.33 | 0.09 | 0.15 | 0.25 | 0.36 | 0.49 | 0.66 | 0.70 | 0.09 | 100 | 0.09 | 99 | 65 | 80 | O |
| Comparative Example 1 | 0.07 | 0.64 | 1.13 | 1.31 | 0.11 | 0.16 | 0.27 | 0.38 | 0.50 | 0.59 | 0.74 | 0.11 | 102 | 0.09 | 100 | 12 | 54 | X |
| Comparative Example 2 | 0.07 | 0.15 | 0.54 | 1.31 | 0.08 | 0.12 | 0.21 | 0.33 | 0.45 | 0.54 | 0.65 | 0.10 | 92 | 0.10 | 102 | 20 | 64 | X |
| Comparative Example 3 | 0.08 | 0.75 | 1.09 | 1.40 | 0.08 | 0.13 | 0.20 | 0.31 | 0.41 | 0.52 | 0.63 | 0.12 | 90 | 0.11 | 100 | 42 | 62 | O |
| Example 3 | 0.08 | 0.17 | 1.10 | 1.37 | 0.12 | 0.19 | 0.32 | 0.48 | 0.59 | 0.74 | 0.83 | 0.10 | 100 | 0.09 | 98 | 48 | 88 | O |
| Example 4 | 0.07 | 0.14 | 1.00 | 1.33 | 0.10 | 0.16 | 0.27 | 0.37 | 0.55 | 0.69 | 0.73 | 0.09 | 97 | 0.09 | 100 | 62 | 80 | O |
| Example 5 | 0.07 | 0.14 | 1.02 | 1.34 | 0.11 | 0.16 | 0.29 | 0.35 | 0.52 | 0.68 | 0.74 | 0.09 | 100 | 0.10 | 97 | 47 | 65 | O |
| Example 6 | 0.08 | 0.16 | 1.12 | 1.35 | 0.13 | 0.18 | 0.28 | 0.45 | 0.62 | 0.71 | 0.84 | 0.10 | 98 | 0.10 | 99 | 60 | 78 | O |
| Example 7 | 0.07 | 0.13 | 0.98 | 1.31 | 0.10 | 0.16 | 0.24 | 0.38 | 0.57 | 0.70 | 0.79 | 0.09 | 98 | 0.09 | 100 | 70 | 85 | O |
| Example 8 | 0.07 | 0.12 | 1.09 | 1.34 | 0.12 | 0.17 | 0.25 | 0.36 | 0.60 | 0.67 | 0.80 | 0.09 | 99 | 0.10 | 98 | 59 | 72 | O |
| Example 9 | 0.07 | 0.12 | 0.99 | 1.34 | 0.11 | 0.14 | 0.28 | 0.34 | 0.49 | 0.69 | 0.78 | 0.09 | 100 | 0.08 | 102 | 75 | 87 | O |
| Example 10 | 0.07 | 0.12 | 0.92 | 1.32 | 0.09 | 0.16 | 0.27 | 0.30 | 0.51 | 0.66 | 0.77 | 0.09 | 101 | 0.10 | 100 | 81 | 90 | O |
| Example 11 | 0.07 | 0.15 | 1.08 | 1.39 | 0.10 | 0.16 | 0.30 | 0.46 | 0.57 | 0.75 | 0.82 | 0.09 | 97 | 0.10 | 101 | 68 | 77 | O |
| Example 12 | 0.07 | 0.16 | 1.02 | 1.33 | 0.12 | 0.18 | 0.31 | 0.45 | 0.58 | 0.72 | 0.79 | 0.10 | 102 | 0.09 | 100 | 73 | 82 | O |

(1) Coloration of the ground part: Values obtained by measuring the undeveloped part on Macbeth densitometer RD-914.

(2) Static sensitivity: Values obtained by pressing the heat-sensitive recording material (heat-sensitive recording paper) under a pressure of 1 kg/cm$^2$ for 5 seconds at varying temperatures of 80° C., 90° C. and 140° C. on a hot plate (HG-100, a product of Toyo Seiki Co., Ltd.), and then measuring the developed color depth on Macbeth densitometer RD-914.

(3) Dynamic sensitivity: Values obtained by color-developing the heat-sensitive recording material on Matsushita's test printer TH-D1 under conditions that voltage was 20 V, pulse period was 5.0 ms (millisecond), resistance was 325 Ω and pulse width was 0.8 to 2.0 ms, and then measuring the developed color depth on Macbeth densitometer RD-914. Only in the dynamic sensitivity test, an overcoat layer of 1μ in thickness was applied to the color-developing layer of the heat-sensitive recording material.

(4) Fastness test: Prior to the fastness tests, the recording sheet for test was color-developed by pressing it under a pressure of 1 kg/cm$^2$ at 140° C. for 5 seconds on the HG-100. The developed color depth was measured on Macbeth densitometer RD-914.

Heat resistance (A): Values obtained by allowing the undeveloped heat sensitive sheet to stand at 60° C. for 24 hours in a constant-temperature apparatus, and then measuring the color depth on Macbeth densitometer RD-914.

Heat resistance (B): The color-developed heat-sensitive sheet was allowed to stand at 60° C. for 24 hours in a constant-temperature apparatus, after which the color depth was measured on Macbeth densitometer RD-4. The heat resistance (B) was calculated according to the following equation:

$$\frac{\text{Color depth after standing}}{\text{color depth before standing}} \times 100\ (\%)$$

The larger the value, the higher the heat resistance.

Moisture resistance (A): Values obtained by allowing the undeveloped heat-sensitive sheet to stand for 24 hours at 40° C. and 90% R.H., and then measuring the color depth on Macbeth densitometer RD-914.

Moisture resistance (B): The color-developed heat-sensitive sheet was allowed to stand for 24 hours at 40° C. and 90% R.H., after which the color depth was measured on Macbeth densitometer RD-914. The moisture resistance (B) was calculated according to the following equation:

$$\frac{\text{Color depth after standing}}{\text{color depth before standing}} \times 100\ (\%)$$

The larger the value, the higher the moisture resistance. Water resistance: The color-developed heat-sensitive sheet was dipped in water for 24 hours, after which the color depth was measured o Macbeth densitometer RD-914. The water resistance was calculated according to the following equation:

$$\frac{\text{Color depth after standing}}{\text{color depth before standing}} \times 100\ (\%)$$

The larger the value, the higher the water resistance. Plasticizer resistance: The color-developed heat-sensitive sheet was lapped in a polyvinyl chloride film and allowed to stand at 40° C. for 15 hours, after which the color depth was measured on Macbeth densitometer RD-914. The plasticizer resistance was calculated according to the following equation:

$$\frac{\text{Color depth after standing}}{\text{color depth before standing}} \times 100\ (\%)$$

The larger the value, the higher the plasticizer resistance.

(5) Blooming: The color-developed heat-sensitive sheet was allowed to stand at room temperature for 3 days, and then the blooming state was macroscopically judged based on the following standard:

O A trace of blooming

X Remarkable blooming

What is claimed is:

1. A heat sensitive recording material which comprises a support and a heat sensitive color-developing layer containing a leuco dye, and acidic substance and a compound represented by the formula (I),

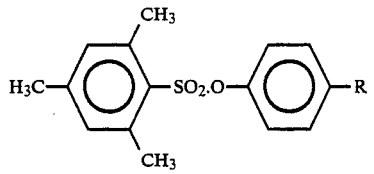

(I)

wherein R represents a hydrogen atom or a methyl group, a leuco dye and an acidic substance on a support.

* * * * *